US007232491B2

(12) United States Patent
Perttilä et al.

(10) Patent No.: US 7,232,491 B2
(45) Date of Patent: Jun. 19, 2007

(54) APPARATUS FOR GLUING OF VENEER SHEETS

(75) Inventors: Marko Perttilä, Nastola (FI); Petri Kymäläinen, Nastola (FI); Ari-Pekka Tiusanen, Nastola (FI)

(73) Assignee: Raute Oyj, Nastoia (FI)

( * ) Notice: Subject to any disclaimer, the term of this patent is extended or adjusted under 35 U.S.C. 154(b) by 57 days.

(21) Appl. No.: 11/143,499

(22) Filed: Jun. 3, 2005

(65) Prior Publication Data

US 2005/0268846 A1 Dec. 8, 2005

(30) Foreign Application Priority Data

Jun. 4, 2004 (FI) ..... 20040771

(51) Int. Cl.
*B05B 13/02* (2006.01)
*B05C 5/00* (2006.01)
*B05C 3/12* (2006.01)

(52) U.S. Cl. ..... 118/324; 118/325; 118/420

(58) Field of Classification Search ..... 118/324, 118/325, 419, 420, 300, 70; 198/406, 373, 198/689.1, 817; 242/528; 156/578
See application file for complete search history.

(56) References Cited

U.S. PATENT DOCUMENTS 1,979,758 A * 11/1934 Merritt ..... 118/324
3,739,745 A * 6/1973 Turpin ..... 118/694
3,973,673 A * 8/1976 Ahluwalia ..... 198/374
5,779,236 A * 7/1998 Duncan et al. ..... 271/276

FOREIGN PATENT DOCUMENTS

EP 1 439 043 A1 7/2004
JP 2000-304515 11/2000

* cited by examiner

*Primary Examiner*—Yewebdar Tadesse
(74) *Attorney, Agent, or Firm*—Connolly Bove Lodge & Hutz LLP

(57) ABSTRACT

Apparatus for applying glue to veneer sheets comprises elements (6, 7, 8) for transporting veneer sheets (3), supported substantially in a horizontal position, to the gluing, a glue applying device (2) for administering glue onto the veneer traveling under it, as well as elements (9, 10, 11) for directing the glued veneers (4), supported substantially in a horizontal position, to a further processing, said conveying elements being located with respect to each other so as to leave in the direction of transport a transfer gap aligned with the glue administering device (2). The device further includes means for forcing the veneer to be glued and the glued veneer at its center portion in the direction of transport to a different level than the edge portions thereof in the direction of transport.

5 Claims, 4 Drawing Sheets

APPARATUS FOR GLUING OF VENEER SHEETS

Figure 1:
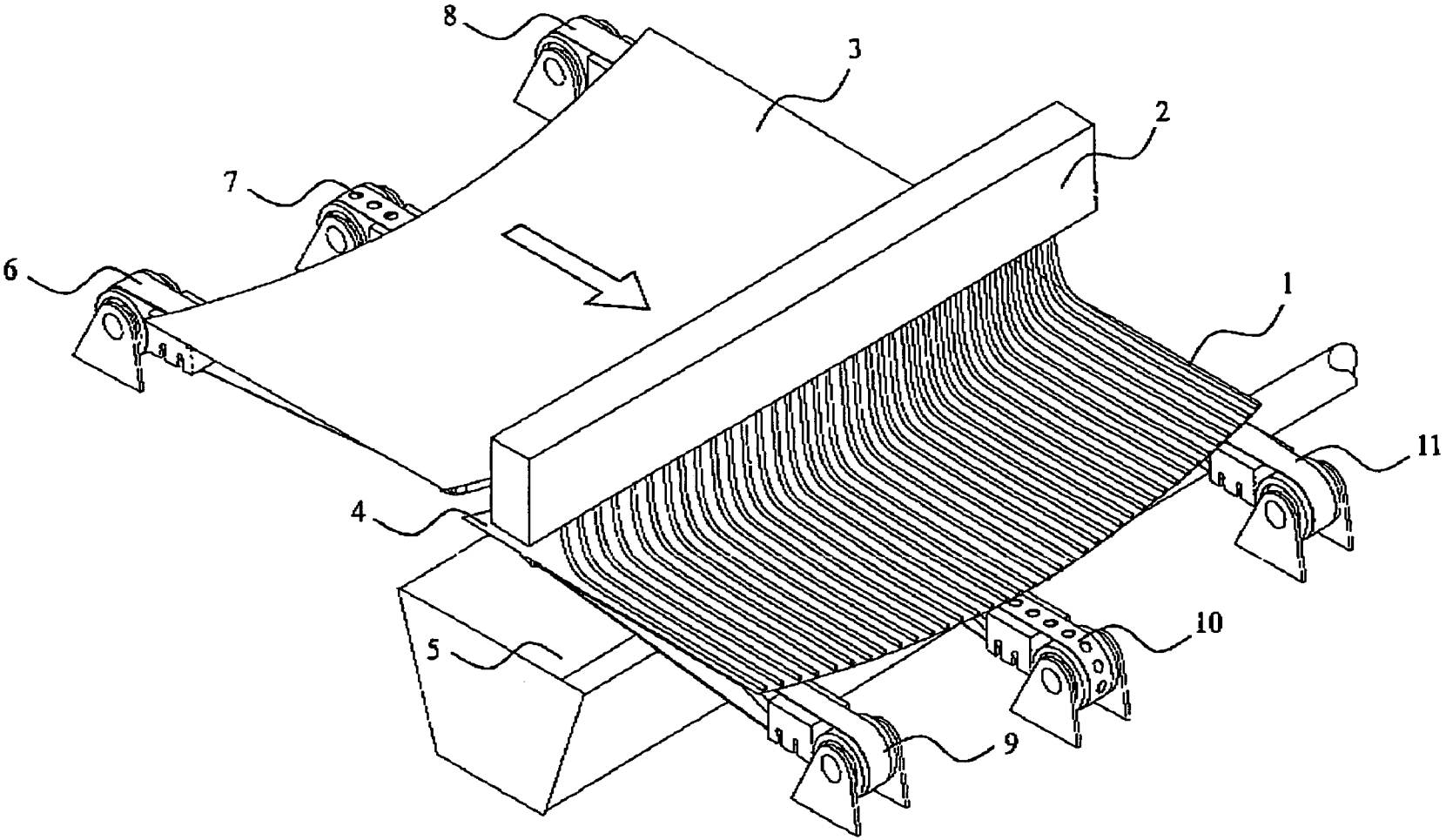

The present invention concerns an apparatus for applying glue onto wood veneer sheets for example in order to joint the veneers for producing plywood panels. The basic construction of this apparatus comprises conveyor elements, on which the veneers are supported when being conveyed substantially on a horizontal plane through the gluing apparatus. The glue is applied to the upper surface of the veneers by running it from a gluing device. The gluing device extends over the veneers in a direction across the proceeding direction of the veneers, and has a row of nozzles on its lower surface for running glue with a predetermined dosage. Traditionally the glue is run foamed.

A problem with this kind of apparatus is that parts of the apparatus easily become tacky. Some of the glue inevitably ends up to the parts of the apparatus, from where it wanders to such veneer surfaces where it is not intended. The glue on a wrong surface causes problems in the later phases of the production. The most problematic point in the gluing device has appeared to be the place where the gluing device itself is situated. The veneer has in its proceeding direction a certain dimension when it reaches the gluing point. Usually this dimension is produced in a preceding cutting phase. In practice a gap remains between the successively proceeding veneers, which gap must be taken into account when controlling the administration of glue. The gap is typically about 50 mm wide, ranging from 0 to 3000 mm. The administration is controlled based on monitoring the proceeding of the veneers, and by starting and stopping the administration, if a gap between the veneers is wider than usual. Short gaps between veneers, instead, do not give rise to cut off the administration. An exception, of course, is the face veneer, where the cutting off must be exactly in conformity with the length of the veneer (no glue allowed on the upper surface). The control of the administration, however is not able to eliminate totally the inaccuracy of the administration, like dripping of the glue from the nozzles after cut-off Therefore the conveyors transporting the veneer have been arranged in the apparatus into two groups, firstly to conveyors for bringing the veneers to the gluing and secondly to conveyors for bringing the glued veneer forward from the glue administering device. Between these conveyor groups there has been left an open space across the transport direction at the point where the glue administering device is situated. Thus, the glue dripping eventually when the gap between the successive veneers is below the glue administering device, is free to drip into a suitable receiver arranged below the gap. Holes eventually existing in a veneer causing the glue to penetrate are not able to cause problems in this arrangement either. One problem, however, that arises is how to guide the veneer to pass over the empty distance inevitably remaining between the transports below the glue administering device.

An improvement for this controlling problem is provided in accordance with the present invention. At the same time, the behavior of the veneer in the gluing apparatus has been substantially improved, also in other respects. This is achieved by providing the veneer transporting apparatuses with means to bend a veneer sheet across its traveling direction both before and after the glue administering device so that the middle area is positioned on a level different from the mutual level of the traveling direction edge areas.

Thus, a flexural stiffness is achieved to a veneer sheet in the gluing apparatus, in other words, the veneer will be bent to an arc in the direction across the direction of traveling.

Figure 2:
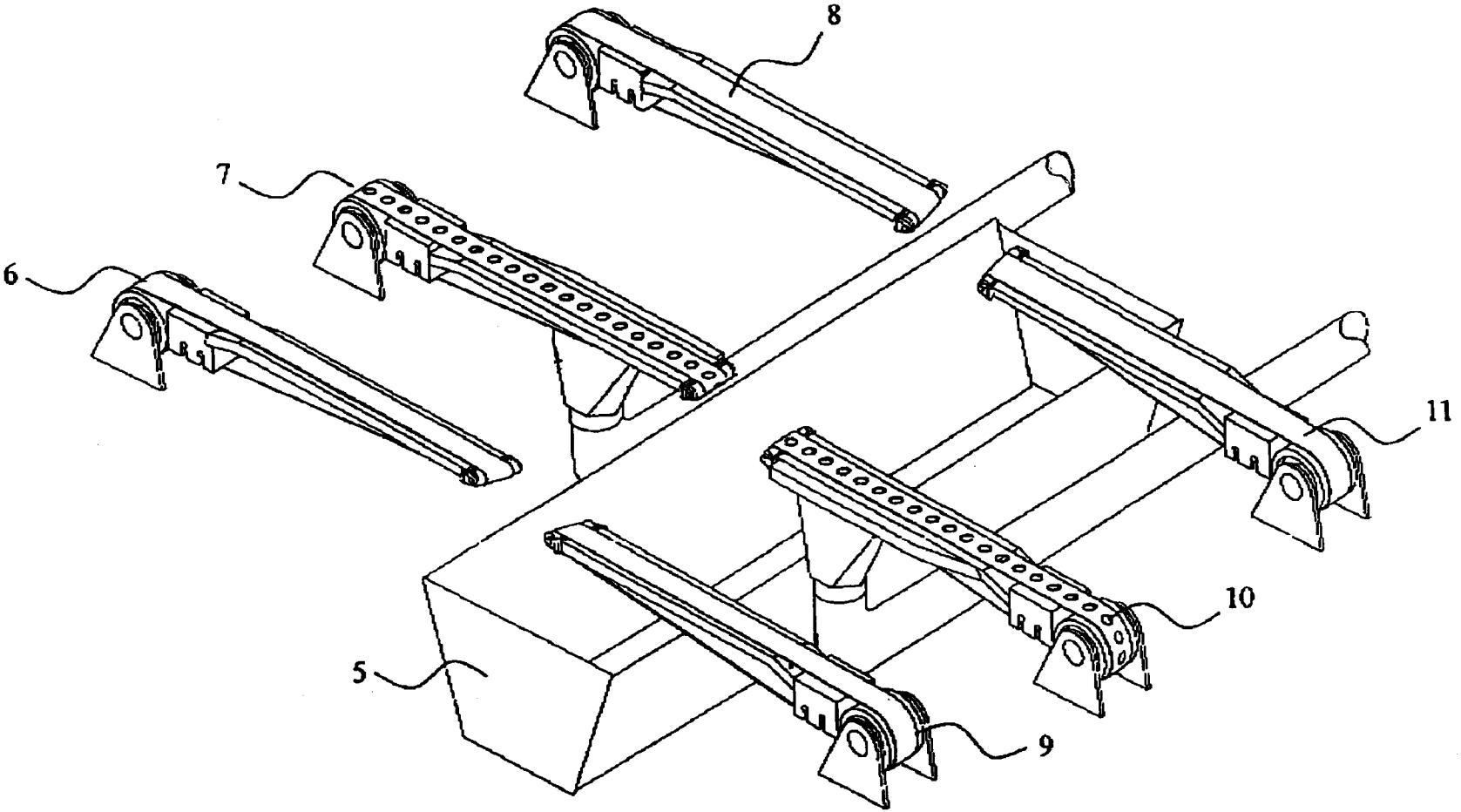
Figure 3:
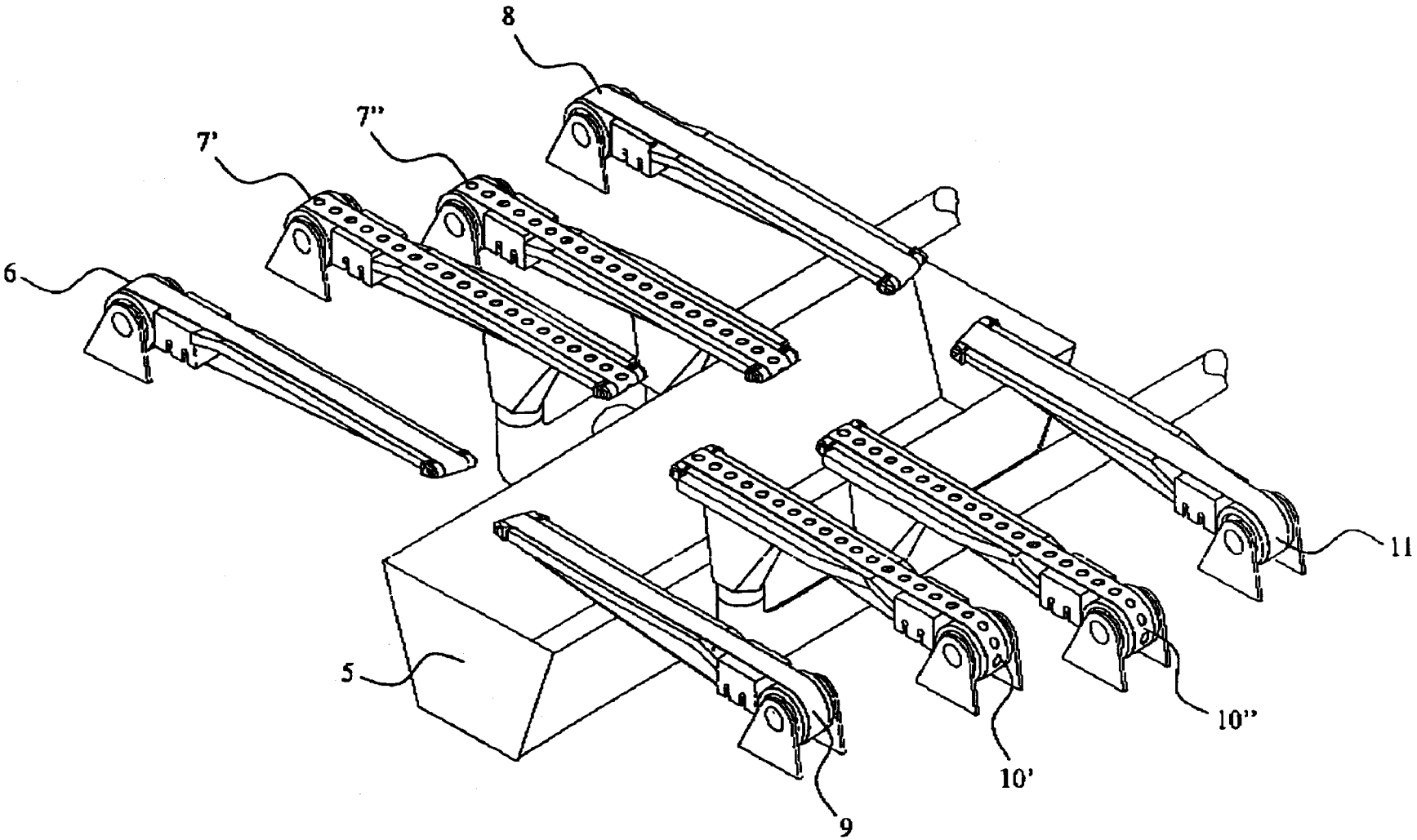
Figure 4:
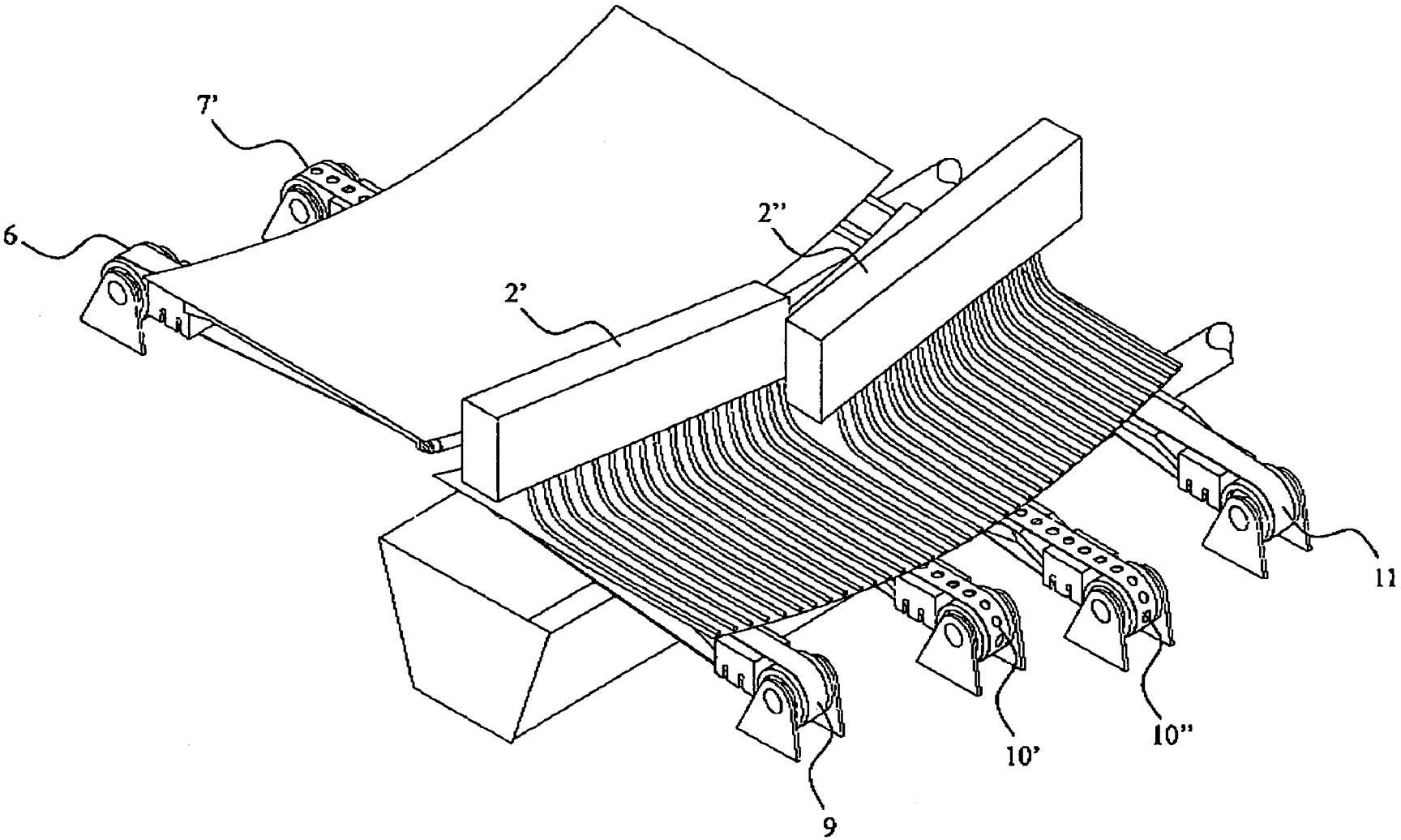

The invention will be described in more detail in the following, with respect to the enclosed drawing, wherein FIG. 1 shows a schematic view of a gluing apparatus in accordance with the present invention, FIG. 2 shows the principal construction of the apparatus of FIG. 1, FIG. 3 shows an alternative embodiment of the construction of the apparatus in accordance with the invention, and FIG. 4 shows an alternative embodiment of the apparatus in accordance with the invention for the part of the gluing device.

FIG. 1 shows a gluing apparatus, wherein glue is dispensed onto a veneer sheet 3 coming to the apparatus, when said veneer sheet travels under a glue administering device 2. The glue is distributed to the veneer from the parallel nozzles of the device 2 as glue stripes 1. The amount of glue for each stripe is administered so that in the following processing phases, where the glued veneer sheet is pressed together with another veneer placed onto it, the glue is spread to cover the whole surface of the veneer sheet.

The arrangement of the devices transporting the veneer supported on the gluing apparatus is illustrated in FIG. 2. The conveyors 6, 7, 8 bring the veneer under the glue administering device (device 2 in FIG. 1) and conveyors 9, 10, 11, respectively, bring the glued veneer forward to the further processing. The conveyors for taking in the veneer are substantially located aligned with the respective conveyors for taking out the veneer, however so that there is a transfer gap left between the conveyors in the direction of transport. The glue administering device is placed above this transfer gap. At the transfer gap there is a free fall for the glue eventually dripping between the successive veneer sheets to a receiver located below, and it will not be in touch with such parts of the apparatus, that could move glue to the surfaces of the veneers to be processed.

The veneer coming to the gluing after a drying process is bend in different directions, as is well known, and it is difficult to direct it to travel controlled under the glue administering device, as well as to travel glued forward to the further processing. In accordance with the invention, the veneer is made significantly more braced in these processing phases by forcing it to bend to some extent in cross direction with respect to its direction of transport. This is provided in the apparatus shown in the figures by forcing the central portion of the veneer in the direction of transport to press to a lower level than the edge portions thereof. This arrangement is visualized in FIG. 2.

The inward conveyors 6, 7, 8 located parallel, have been implemented so that the conveyors 6, 8 supporting the edge portions of the veneer are belt conveyors located at the same level with each other, whereas the conveyor 7 between them, being in contact with the central portion of the veneer, is a suction belt conveyor located on a lower level. As a result of the suction caused by the conveyor 7, the central portion of the veneer is pressed so as to form a trough. At the same time, the veneer is substantially braced in its direction of transport, whereby it is significantly better supported to reach over the transfer gap to the outward conveyors 9, 10, 11. The veneer bent to trough in cross direction with respect to its direction of transport is also realigned quite easily for the part of local distortions caused by the drying, which for its part facilitates the handling of the veneer.

From the point of view of the operation of the device it is favorable that also the outward conveyors 9, 10, 11 are implemented in the corresponding way as the inward conveyors 6, 7, 8, although it is suitable to locate the outward conveyors staggered on a lower level with respect to the inward conveyors. Through staggering, the veneer can be prevented from colliding with the outward conveyors after it has passed over the transfer gap. The staggering can have a size ranging at about 50 mm.

For the part of the inward conveyors, the bending of the veneer can also be implemented by means of a pressing member operating on top of a usual belt conveyor 7 located in the middle. On the glued side this arrangement if naturally not applicable due to staining.

An alternative embodiment of the construction and operation of the device is that the veneer is made to bend upwards in the middle, whereby the inward conveyors 6 and 8 and the outward conveyors 9 and 11, respectively, are on a lower level than the conveyors 7 and 10, and preferably implemented as suction conveyors. For the part of the conveyors 6 and 8 the pressing member described above is also applicable.

FIG. 2 illustrates one special feature of the embodiment of the invention, where the conveyors 6, 8 and 9, 11, respectively, supporting the edges of the veneer, are implemented so that their conveying surface is turned around a transport direction axis in different degrees at different points of the length of the conveyor. Thereby the best possible support can be provided for the veneer at the different points of its advance.

As shown in FIG. 3, there can be a plurality of conveyors on the inward side and outward side, arranged parallel, for instance two parallel suction conveyors in the middle. In the embodiment of the figure, the conveyors have been located staggered in the direction of transport for an embodiment of the gluing device in accordance with FIG. 4. In this embodiment, the gluing device is implemented in two parts, and the parts 2', 2" are inclined imitating the bending of the veneer below, whereby the distribution distance from the distribution device to the surface of the veneer can be made more coherent across the total width of the gluing device.

The invention claimed is:

1. An apparatus for applying glue on veneer sheets, said apparatus comprising:

first conveyor elements for transporting an unglued veneer sheet, supported substantially in a horizontal position, in a transport direction to a gluing point or area;

a glue applying device for administering glue onto the unglued veneer sheet as the unglued veneer sheet travels under the glue applying device, so as to form a glued veneer sheet;

second conveyor elements for directing the glued veneer sheet, having the glue administered on a top surface thereof and supported substantially in a horizontal position, to further processing areas or phases, said first conveying elements and said second conveying elements being located with respect to each other so as to leave a transport gap in the transport direction, said transfer gap being aligned with the glue applying device; and means for forcing the unglued veneer sheet and means for forcing the glued veneer sheet, wherein:

as the unglued veneer sheet lies on the first conveyor elements, said means for forcing the unglued veneer sheet are arranged to force a central portion of the unglued veneer sheet in the transport direction to a different level than edge portions of the unglued veneer sheet in the transport direction; and as the glued veneer sheet lies on the second conveyor elements, said means for forcing the glued veneer sheet are arranged to force a central portion of the glued veneer sheet in the transport direction to a different level than edge portions of the glued veneer sheet in the transport direction.

2. The apparatus of claim 1, wherein:

the first conveyor elements are formed from at least one first central belt conveyor supporting the central portion of the unglued veneer sheet and first outer belt conveyors supporting the edge portions of the unglued veneer sheet;

the second conveyor elements are formed from at least one second central belt conveyor supporting the central portion of the glued veneer sheet and second outer belt conveyors supporting the edge portions of the glued veneer sheet;

said at least one first central belt conveyor and said at least one second central belt conveyor are located at a lower level than said first outer belt conveyors and said second outer belt conveyors; and said first at least one central belt conveyor and said at least one second central belt conveyor are suction belt conveyors.

3. The device of claim 2, wherein:

transporting surfaces of said first outer belt conveyors are rotated around an axis parallel with the transport direction at different degrees at different points along the lengths of said first outer belt conveyors; and transporting surfaces of said second outer belt conveyors are rotated around an axis parallel with the transport direction at different degrees at different points along the lengths of said second outer belt conveyors.

4. The apparatus of claim 1, wherein said second conveyor elements are located at a lower level than said first conveyor elements.

5. The apparatus of claim 1, wherein the apparatus comprises a plurality of conveyor element pairs each comprising one of said first conveyor elements and an opposing one of said second conveyor elements, wherein the transfer gap is staggered in the transport direction between adjacent ones of said conveyor element pairs, and wherein the gluing device has two parts corresponding to staggering of the transfer gap.

* * * * *